United States Patent [19]

Green

[11] 4,370,532

[45] Jan. 25, 1983

[54] LIGHTED ELECTRICAL PUSHBUTTON SWITCH

[75] Inventor: Todd C. Green, Chicago, Ill.

[73] Assignee: Illinois Tool Works Inc., Chicago, Ill.

[21] Appl. No.: 237,346

[22] Filed: Feb. 23, 1981

[51] Int. Cl.[3] ..... H01H 3/12

[52] U.S. Cl. ..... 200/314; 200/333

[58] Field of Search ..... 200/314, 313, 333

[56] References Cited

U.S. PATENT DOCUMENTS

| | | | |
|---|---|---|---|
| 2,262,170 | 11/1941 | Douglas | 200/167 |
| 2,305,185 | 12/1942 | Merkel | 200/4 |
| 2,749,415 | 6/1956 | Davis | 200/167 |
| 2,904,662 | 9/1959 | Spring | 200/167 |
| 2,953,668 | 9/1960 | Bassett, Jr. | 200/167 |
| 3,192,352 | 6/1965 | Piber | 200/314 |
| 3,267,926 | 8/1966 | Prince | 200/167 |
| 3,271,530 | 9/1966 | Wirsching | 200/314 |
| 3,336,456 | 8/1967 | Ploetz | 200/167 |
| 3,377,452 | 4/1968 | Bock et al. | 200/167 |
| 3,619,591 | 11/1971 | Korski | 240/2 |
| 3,819,928 | 6/1974 | Kuroyama et al. | 240/2 |
| 3,895,204 | 7/1975 | Lewis | 200/314 |
| 3,927,290 | 12/1975 | Denley | 200/314 |
| 4,017,700 | 4/1977 | West | 200/314 |
| 4,163,883 | 8/1979 | Boulanger | 200/314 |

FOREIGN PATENT DOCUMENTS

| | | | |
|---|---|---|---|
| 2379896 | 1/1978 | France | 200/314 |
| 1067231 | 5/1967 | United Kingdom | 200/314 |

*Primary Examiner*—Willis Little

*Attorney, Agent, or Firm*—Thomas W. Buckman

[57] ABSTRACT

An electrical lighted pushbutton switch is constructed by inserting a light source in the housing of the switch below a depressible actuating plunger that has a keycap retaining post. The keycap retaining post has a passageway which runs through it from its top surface to its bottom surface which is in alignment with the light source. The removeable keycap has locking detent provisions which cooperate with a mating locking groove on the retaining post. The keycap has a centrally located channel through its top surface that leads to an open cavity and is in alignment with the passageway through the keycap retaining post. A light pipe is inserted that has an upper section that fits into the channel of the keycap, a flange located below this upper section which keeps the light pipe from being forced upwardly through the channel in the keycap and a lower tapered section which is inserted into the passageway of the keycap retaining post.

3 Claims, 3 Drawing Figures

LIGHTED ELECTRICAL PUSHBUTTON SWITCH

BACKGROUND OF THE INVENTION

Lighted electrical pushbutton switches have been constructed which required that the keycap be made of special transparent or translucent material; and in general, the actuating buttons of these switches did not resemble conventional typewriter keyboard buttons in shape. In many applications, it is desirable to be able to provide a low-cost basic switch design with a keyboard type keycap which may be utilized with either a lighted or a non-lighted configuration with conversion from one to the other being accomplished at a minimum of expense and inconvenience.

DESCRIPTION OF THE DRAWINGS

The present invention is described by reference to the drawings in which.

TECHNICAL DESCRIPTION OF THE INVENTION

Figure 1:
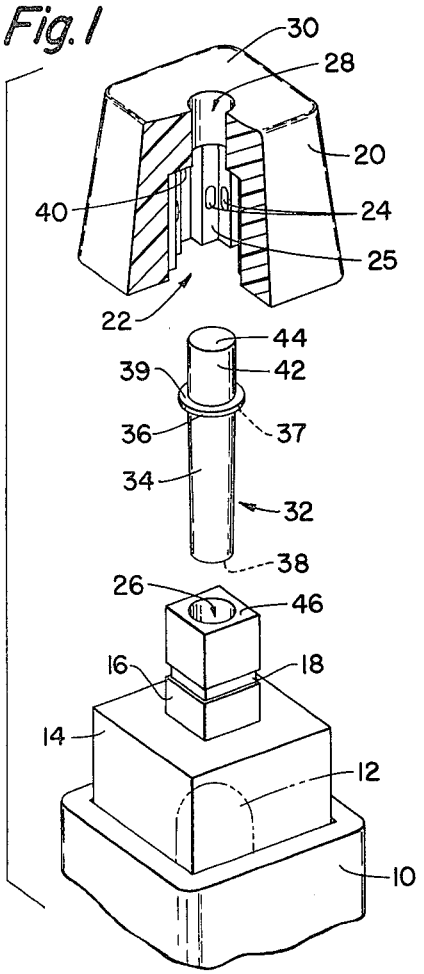
FIG. 1 is an exploded view of the portions of an electrical lighted pushbutton switch that are associated with the present invention with the keycap being partially broken away.
Figure 2:
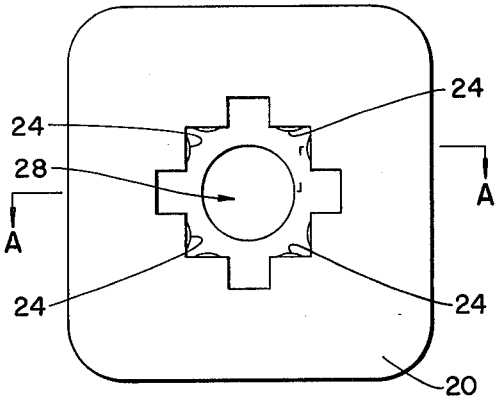
FIG. 2 is the bottom view of the keycap of the present invention.
Figure 3:
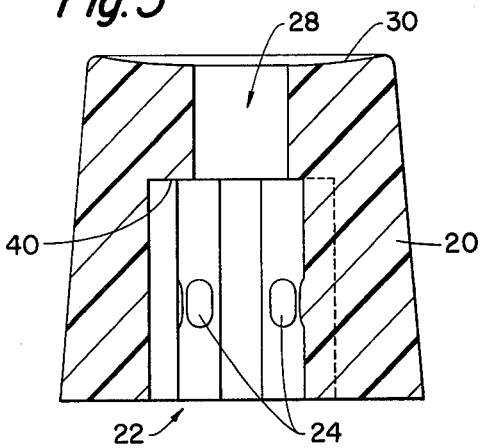
FIG. 3 is a cross-sectional view along the lines A—A of FIG. 2 which shows the detent provisions on the keycap for locking the keycap onto the keycap receiving post of the actuating pushbutton member.

Portions of an electrical lighted pushbutton switch which are associated with a lighted switch in accordance with the present invention are shown in perspective view in FIG. 1. The upper portion of the housing 10 of the switch houses a light source 12 such as a light emitting diode (LED). The actuating pushbutton 14 is mounted for reciprocating movement in the housing 10 and surrounds the LED 12. The pushbutton 14 also has a keycap retaining post 16 which extends upwardly therefrom. Intermediate the ends of the post 16, a groove 18 is formed which receives corresponding mating detent provisions formed on the keycap 20. FIG. 2 shows the bottom of the keycap, looking up into the central cavity 22, which is partially exposed in the cut-away view of FIG. 1. A number of detent buttons 24 are formed on the walls 25 so that when the keycap 20 is forced onto the post 16 the detent buttons 24 will project into the groove 18 thereby locking the keycap 20 onto the keycap retaining post 16. It should be noted, however, that the particular detent locking mechanism that is disclosed and described does not form part of the present invention; and suitable design for locking a keycap onto a keycap retaining post may be employed.

The actuating pushbutton 14 and the keycap retaining post of the present invention may be constructed of an opaque plastic material, as may the keycap 20, thus allowing for the potential utilization of more types of plastic materials for the construction of the switch than are available for lighted pushbutton switches which require transparent or translucent materials. The post 16 of the present switch has a cylindrically-shaped passageway 26 which leads all the way through the post into the interior of the actuation button 14 so that it is substantially in line with the light source 12. (In the past, in the molding of keycap retaining posts, a blind hole has been formed which ran part of the way through the posts; but this was done for molding considerations.)

The keycap 20 is preferably shaped like a typewriter or electronic keyboard cap and has a centrally located channel 28 which passes through the upper surface 30 of the keycap into communication with the cavity 22 in the interior of the keycap. The channel 28 is in alignment with the passageway 26 so that the light from the light source 12 will pass both through the passageway 26 and the aperture 28 so as to indicate to an operator when the switch has been actuated.

In order to complete the lighted pushbutton switch of the present invention, so as to provide a wide viewing area which allows for the use of high efficiency, diffused or non-diffused light emitting diodes, a flanged light pipe 32 is also employed. The lower section 34 of the flanged light pipe 32 is tapered from a larger diameter portion just below the disc-shaped flange 36 to a small diameter portion at its lower end 38. This provides for a secure fit of the light pipe when it is forced into the tapered diameter circular passageway 26 for substantially the length of the passageway with the lower surface 37 of the flange 36 resting against the upper surface 46 of the post 16. The upper section 42 of the pipe is cylindrical and of a substantially uniform diameter and fits into the channel 28 so that the upper surface 44 of the light pipe is substantially coplanar with the adjacent portion of the upper surface 30 of the keycap 20. When the keycap 20 is locked onto the post 16, the upper surface 39 of flange 36 is being forced against the lower surface 40 of the keycap 20 to position surface 44 of the light pipe in the same plane as surface 30 of the keytop.

The present invention, therefore, allows for easy and inexpensive conversion of a low-cost pushbutton switch from a lighted to a non-lighted version, or vice versa, merely by exchange of the type of keycap employed. The lighted keycap would have the channel 28 and the non-lighted keycap would not. In addition, of course, the light source 12 and the light pipe 32 may be removed from the non-lighted version, if desired, to save the expense of these parts. Thus, a wide variety of keycap styles and lighting options may be available to the user with a simple economical design that does not require transparent or translucent materials for the keycap.

What is claimed is:

1. A lighted pushbutton switch comprising a light source, a housing that houses said light source, an actuating pushbutton mounted for reciprocating movement in said housing, said pushbutton having a keycap retaining post that extends therefrom, a keycap that has a retaining means which cooperates with said post to secure said keycap on said keypost, said keypost also having a passageway which extends all the way through said keypost into the interior of said housing so that it is in alignment with said light source, and said keycap having a channel therein which is in light communication with said passageway so that light from said light source that passes through said passageway will also pass through said channel said keycap to an outside viewer and a light pipe that has a first section which inserted into said passageway and a second section which projects into said channel, said keycap including a cavity adapted to surround the key post, the passageway in the keycap communicating with the cavity, said light pipe including abutment and alignment means situated between the first and second sections and adapted to cooperate with a surface on the cavity of the keycap and the free end surface of the key post after said keycap is assembled onto the post.

2. A lighted pushbutton switch, as claimed in claim 1, wherein said first section of said light pipe extends for substantially the length of said passageway and said second section of said light pipe extends for substantially the length of said channel.

3. A lighted pushbutton switch is claimed in claim 2 wherein an increased diameter flange is formed intermediate said first and second sections, said first section of said light pipe is cylindrically shaped and tapered from a large diameter portion adjacent said flange to a smaller diameter area at the end of said light pipe which is closest to said light source when said light pipe is inserted into said passageway and said channel, said passageway and said second section of said light pipe are both cyclindrically-shaped and tapered.

* * * * *